United States Patent [19]

Kalmar

[11] 4,375,302

[45] Mar. 1, 1983

[54] PROCESS FOR THE IN SITU RECOVERY OF BOTH PETROLEUM AND INORGANIC MINERAL CONTENT OF AN OIL SHALE DEPOSIT

[76] Inventor: Nicholas Kalmar, 637 Arlington Ave., Berkeley, Calif. 94707

[21] Appl. No.: 126,955

[22] Filed: Mar. 3, 1980

[51] Int. Cl.[3] ..... E21B 43/28; E21C 41/10; E21C 41/14

[52] U.S. Cl. ..... 299/4; 166/245

[58] Field of Search ..... 299/2, 4, 5; 166/245, 166/259

[56] References Cited

U.S. PATENT DOCUMENTS

| | | | |
|---|---|---|---|
| 2,901,043 | 8/1959 | Campion et al. | 166/259 |
| 3,380,526 | 4/1968 | Altamira et al. | 166/245 |
| 3,572,838 | 7/1969 | Templeton | 299/4 |
| 3,759,574 | 9/1973 | Beard | 299/4 |
| 3,779,601 | 12/1973 | Beard | 299/4 |
| 4,065,183 | 12/1977 | Hill et al. | 299/4 |

*Primary Examiner*—Ernest R. Purser
*Attorney, Agent, or Firm*—Owen, Wickersham & Erickson

[57] ABSTRACT

A process for obtaining useful products from an oil shale formation that has intermixed nahcolite and dawsonite. An aqueous solution of sodium hydroxide, containing a surfactant, is injected into the formation via wells. The sodium hydroxide reacts with the nahcolite to yield a sodium carbonate solution, which is withdrawn for further processing. Thereafter the shale is retorted in situ, with controlled pyrolysis while supplying air in controlled amounts, and petroleum products are recovered. Then water is sent into the retorted formation to produce steam, which is recovered. At some stage before or after the retorting, the dawsonite is reacted with NaOH and recovered as sodium aluminate in solution, which may be hydrolyzed or carbonated above ground to precipitate hydrated alumina. Carbon dioxide may be added to the recovered sodium carbonate aboveground to precipitate sodium bicarbonate, which may be heated to form solid sodium carbonate. The calcium carbonate in the formation may be converted to calcium oxide, which is slaked and then reacted with sodium carbonate in water solution form to yield calcium carbonate and sodium hydroxide, the latter being withdrawn while the resulting calcium carbonate remains to support the overburden.

33 Claims, 8 Drawing Figures

PROCESS FOR THE IN SITU RECOVERY OF BOTH PETROLEUM AND INORGANIC MINERAL CONTENT OF AN OIL SHALE DEPOSIT

BACKGROUND OF THE INVENTION

This invention relates to a process for recovering in situ both petroleum and minerals from an oil shale deposit.

Oil shale deposits in Colorado and Wyoming have been well known for over fifty years. The Green River Formation, covering an area of approximately seventeen thousand square miles in south-western Wyoming, north-eastern Utah and north-western Colorado, has oil shale deposits with total oil resources estimated to be eight trillion barrels of oil in oil shales containing over ten gallons of oil per ton. The Piceance Creek Basin alone, in Colorado, has deposits containing 1.2 trillion barrels of oil in oil shales having oil content of over fifteen gallons per ton. The amount of oil in this formation alone is sufficient to supply the United States with oil for approximately one hundred thirty years, assuming a consumption of twenty-five million barrels per day.

However, recovery of the petroleum from these enormous deposits has never been economical. Even after the huge recent increases in oil prices on the world market, the projected costs for recovering from this shale has remained higher than the costs of purchasing the oil in the world market.

An object of this invention is to make it economical to produce oil from shale deposits. This object can be achieved according to the present invention by a long-term process in which inorganic minerals are also recovered by solution mining and by linking the various processes together.

The practice of solution mining in situ of oil shale deposits has been previously proposed. The prior-art has proposed both leaching after retorting (e.g., Prats U.S. Pat. No. 3,502,372 and Garret U.S. Pat. No. 3,661,423) and leaching before retorting (e.g., Papadopoulos et al U.S. Pat. No. 3,700,280, Beard U.S. Pat. Nos. 3,759,574, 3,779,601 and 3,779,602, Closmann et al, U.S. Pat. Nos. 3,945,679, 3,957,306, and 3,967,853, Pearson et al U.S. Pat. No. 4,059,308, Hill et al U.S. Pat. No. 4,065,183, and Bohn et al U.S. Pat. No. 4,083,604. Various methods for solution mining have been proposed in these patents: injections of steam, hot-water, aqueous solutions of lye or lime, aqueous acid solutions, and so on.

However, these patents evince no interest in or processes for recovering the inorganic mineral values; they relate only to creating voids in the shale. Little, if anything, has even been said about possible recovery of the mineral values, and nothing has been said about how recovery is feasable.

The Piceance Creek Basin formation, in addition to its petroleum values, also contains the locally abundant, but otherwise rare minerals nahcolite, $NaHCO_3$ and dawsonite, $NaAl(OH)_2CO_3$, both in large quantities. The reserve of these minerals in the Piceance Creek Basin is estimated to be: thirty billion tons of nahcolite and twenty-two billion tons of dawsonite. Similarly, in Utah and Wyoming the shale contains large amounts of trona, $Na_2CO_3.NaHCO_3.2H_2O$, and other minerals.

The nahcolite can be converted to soda ash ($Na_2CO_3$) and/or caustic soda (NaOH). The stoichiometric equivalent of 30 billion tons of nahcolite ($NaHCO_3$) is 18.9 billion tons of $Na_2CO_3$, or 14.3 billion tons of NaOH, or any combination of the two.

The dawsonite can be decomposed, and the individual products of decomposition recovered. The stoichiometric equivalent of 22 billion tons of dawsonite, $NaAl(OH)_2CO_3$ is 8.1 billion tons of $Na_2CO_3$, or 6.1 billion tons of NaOH, or any combination of the two, plus 7.8 billion tons of alumina ($Al_2O_3$), or 4.1 billion tons of aluminum, or any combination of the two. The aluminum contained in this deposit of dawsonite is sufficient to supply the aluminum needs of the United States for several hundred years, and could eliminate dependence on imported raw materials.

ABOVE-GROUND PROCESSING HAS DISADVANTAGES

The process of above-ground retorting comprises mining the oil shale, crushing the shale into small size gravel-like pieces, heating the crushed shale in large ovens or retorts, recovering its petroleum values, cooling the spent shale, and finally disposing of the retorted spent shale residue. It has been proposed to mine the shale by the room-and-pillar method, in which large underground cavities or rooms are excavated, with supporting columns or pillars of shale left between the rooms. Since, in this method, the pillars must remain forever underground and their mineral values cannot be utilized, the shale which could be mined by this method would be only about 55–75% of the total shale present. In other words, there would be a 30–45% loss of shale and therefore of its oil and mineral content. According to current estimates, the room-and-pillar mining method would become economical in the foreseeable future only for shales containing over thirty gallons per ton of oil.

An alternative proposed method is that of pit mining, by first removing or stripping off the overburden and then mining the oil shale. Tremendous land scars result from this process. The size of the pits would be several thousand feet in diameter and up to three thousand feet deep. Current estimates are that open pit mining would become economical in the foreseeable future only for shales containing over twenty gallons per ton of oil.

In both pit mining and room-and-pillar mining, apart from the mining itself, the shale would have to be transported, crushed, and screened. These process steps would be quite expensive and would consume large amounts of energy. Moreover, the construction and operation of above-ground retorts is expensive. Still further, the residue of the retorting, the spent shale, has to be disposed of. The quantity of this residue, depending on the oil content of the shale, is approximately 80–90% of the weight of the mined shale.

For example, for a plant to produce one-million-barrels of petroleum per day, the quantity of the shale which would have to be retorted (assuming 100% recovery of the oil, and 30 gallons of oil per ton of shale) would be 1.4 million tons per day or 511 million tons per year. Mining these quantities of shale for above-ground processing would necessitate an approximate doubling of the total current underground mining capacity of the U.S.A. Moreover, the residue, or spent shale, which in this example would be approximately 85% by weight of the shale, would be 1.19 million tons per day and 434 million tons per year. The disposal of such quantities would cause considerable problems. Moreover, not only is the space requirement very high, but there is a danger that the water-soluble mineral content of the spent shale would be leached out by rain and would contaminate the surface and subterranean waters.

ADVANTAGES OF IN SITU OPERATION ACCORDING TO THE PRESENT INVENTION

In the present invention, both room-and-pillar mining and open-pit mining are dispensed with, and the need to transport large quantities of shale is eliminated. By eliminating these expenses, shale with lower kerogen (or oil) content can be processed more economically. In this invention, the retorted and extracted residue remains underground, so that no residue has to be disposed of above-ground. The landscape is not scarred. Also, the crushing and screening of large quantities of shale is eliminated, and there is no need to build, maintain, and operate large above-ground retorts.

In the present invention, the water-soluble minerals are extracted from the deposit during the process and are processed. As a result, the ground and surface waters are not contaminated by leaching of residues, as they would be when above-ground retorting is used.

The present invention utilizes not only the kerogen (oil) content of the shales, but also its aluminum content (from dawsonite and nordstrandite), and its sodium content (from nahcolite, trona, dawsonite, etc.). Because of the recovery of minerals other than oil, the process as a whole becomes more economical. Thus, the recovery of aluminum makes it possible to reduce or completely eliminate the importation of bauxite and alumina, and the invention makes it possible to produce alumina ($Al_2O_3$) without the normal elevated temperatures for digestion under pressure, without the need for the separation, washing, and disposal of red mud, and without the use of alkali from remote commercial sources.

Furthermore, the process of this invention is compatible with the proposed fracturing methods, such as hydraulic methods and explosive methods, both conventional and nuclear.

SUMMARY OF THE INVENTION

The invention is basically a process for obtaining useful products from an oil shale formation that contains, for example, intermixed nahcolite and dawsonite. It should be understood that although the process is described for oil shale containing nahcolite ($NaHCO_3$) and dawsonite ($NaAl(OH)_2CO_3$), it can be applied with minor modifications to shales containing other minerals, such as halite, trona, and nordstrandite, for example, or containing no sodium minerals.

A series of wells is drilled into the formation from aboveground. The wells may be arranged in a hexagonal pattern with a well in the center of each hexagon.

Through these wells, an aqueous solution of sodium hydroxide containing a surfactant is injected into the formation. The sodium hydroxide reacts with the nahcolite to yield sodium carbonate and water, as a sodium carbonate solution, and this solution is withdrawn for further processing. The in situ formation is then preferably dried somewhat.

Thereafter, the shale is retorted in situ, with controlled pyrolysis, sending air in controlled amounts down some of said wells and while recovering petroleum products up through other wells.

After this retorting step is completed in any location, water is sent down through some wells into the retorted formation to produce steam, and the steam is recovered through other wells.

The process also includes reacting the dawsonite with using an excess of sodium hydroxide; this step can be taken either before retorting, along with the reaction of the nahcolite, or after the retorting. In either event, the dawsonite reaction product is withdrawn as sodium aluminate in solution through some of the wells. Aboveground, the resulting sodium aluminate may be hydrolyzed to precipitate hydrated alumina and sodium hydroxide, or carbon dioxide may be added to the sodium aluminate solution aboveground to precipitate hydrated alumina and yield sodium carbonate. The hydrated alumina may then be calcined, while the sodium carbonate may be treated with carbon dioxide to precipitate sodium bicarbonate.

The basic process may include the additional step of adding carbon dioxide aboveground to much or all of the recovered sodium carbonate, to precipitate sodium bicarbonate, and the sodium bicarbonate may then be heated to form solid sodium carbonate.

The process may also include the step of converting calcium carbonate in the formation to calcium oxide, slaking that, and then adding recovered sodium carbonate in water solution, via some of said wells, to the calcium hydroxide to yield calcium carbonate and sodium hydroxide, and withdrawing the sodium hydroxide from some wells. The calcium carbonate preferably stays below and helps to support the over-burden.

The process may additionally include, after the first solution mining step but prior to the retorting step, the step of enlarging (e.g., hydraulically or explosively) the voids in the formation which are created by removal of the soluble minerals.

OUTLINE OF ONE PREFERRED EMBODIMENT

One preferred embodiment of the process can be summarized as follows, although if the conditions require, some of the steps can be omitted or modified. Moreover, the process can be adapted to the different mineral deposits of the Green River formation. Preceding the steps outlined below, a pattern of wells is drilled, preferably in a hexagonal pattern with a well also at the center of each hexagon.

STEP 1

Extraction of the Nahcolite

An aqueous solvent containing a wetting agent is injected through some wells to dissolve the water soluble minerals, such as nahcolite, halite, and trona, present in the particular deposit. For the nahcolite, the solvent contains caustic soda, NaOH. The dissolved mineral solution is then withdrawn through some other wells. The extraction creates porosity, which can be enlarged, if desired, by using explosives, or by borehole mining techniques. The withdrawn mineral contents are thereby made available for recovery of products to be shipped or for use in further steps of the overall process, as shown below.

STEP 2

Retorting and Oil Recovery

The kerogen content of the shale is pyrolyzed in situ by controlled combustion, injecting air through some wells. At this time, the dawsonite in the formation decomposes, and the petroleum derived from the kerogen is recovered through some other wells.

STEP 3

Steam Generation

Before the shale cools from Step 2, water is pumped down through some wells into the hot formation, and the steam developed is recovered through some other wells and utilized in other steps of the process, or useful energy is produced for use elsewhere or in other ways.

STEP 4

Extraction of the Soda Ash

The retorted shale is then extracted with an aqueous solution to dissolve the $Na_2CO_3$ formed by the decomposition of the dawsonite in the retorting Step 2.

STEP 5

Alkaline Extraction of the Alumina

The retorted shale is extracted with caustic soda, solution to dissolve the alumina, $Al_2O_3$, formed by the decomposition of dawsonite.

STEP 6

Combustion of the Carbonaceous Residue and the Waste Gases

The carbonaceous residue from the retorted and extracted shale is then ignited. Waste gases from other steps in the processes, including those from Steps 2 and 3, may also be burned underground in this step. The calcite, $CaCO_3$, and some dolomite, $CaMg(CO_3)_2$, where present, decompose partially to quicklime, CaO and MgO.

STEP 7

More Steam Generation

Water is again pumped down into the hot formation, and the steam generated is recovered and utilized. Some slaking of the lime occurs.

STEP 8

Causticizing

Sodium carbonate solution is pumped through the spent shale and reacts with the lime, to form caustic soda, NaOH, and calcium carbonate, $CaCO_3$.

STEP 9

Precipitation of the Alumina

Alumina hydrate, $Al_2O_3.nH_2O$ is then precipitated aboveground from the extract obtained in Step 5. This may be done by hydrolysis or by using carbon dioxide, $CO_2$. The precipitated alumina hydrate may then be calcined to alumina, $Al_2O_3$.

STEP 10

Precipitation of the $NaHCO_3$

The saturated $Na_2CO_3$ solution is treated with $CO_2$ gas until all the $Na_2CO_3$ is converted to $NaHCO_3$. Due to the differences in solubilities, the major part of the $NaHCO_3$ precipitates as solid crystals.

STEP 11

Calcination of the $NaHCO_3$

The solid $NaHCO_3$ produced in Step 10 may be heated to decompose it to anhydrous $Na_2CO_3$, $CO_2$ gas, and water.

OUTLINE OF A SECOND PREFERRED EMBODIMENT

An alternative process has the following steps after drilling of the wells. Again, depending on the shale formation, some steps may be omitted and others modified.

STEP 1

Extraction of Nahcolite and Alumina

In this form of the invention, both the nahcolite and dawsonite are dissolved by a mixture of a saturated solution of $NaHCO_3$ (which may be obtained from Step 7 below) after the procedure has gotten well under way, and NaOH (which may be obtained from step 5 below). The solution is injected through certain wells into the formation. The NaOH reacts with the nahcolite to form soda ash:

$$NaHCO_3 + NaOH \rightarrow Na_2CO_3 + H_2O,$$

and also reacts with the dawsonite to form soluble sodium-aluminate and soda ash:

$$NaAl(OH)_2CO_3 + 2NaOH \rightarrow NaAlO_2 + Na_2CO_3 + 2\text{-}H_2O.$$

To keep the sodium-aluminate, $NaAlO_2$, in solution, an excess of NaOH is necessary, preferably an excess of from three to ten times the stoichiometric amount. A wetting agent is also used in the solution. The solution recovered may be processed in Step 6, below.

This first step results in an approximately 25% porosity in the formation, by the dissolution and withdrawal of the nahcolite and dawsonite.

STEP 2

Retorting

Preferably, the wells have been arranged and drilled in a hexagonal pattern with a well in the center of each hexagon; each center well is preferably used as an injection well, and the surrounding six wells are preferably used as recovery wells for this step. They may be used similarly in other steps.

Air, oxygen, an air-oxygen mixture, or air diluted with process gases is forced through the injection wells into the non-porous shale formation. The shale is ignited at the recovery wells. The oxidizing gases flow towards the recovery wells, and the combustion front progresses from the recovery wells towards the injection well. The produced liquids and gases are recovered at the recovery wells, their recovery being aided by the flow of the pumped-down gases.

After thereby increasing the porosity and enlarging the fissures in the formation by this countercurrent combustion, the retorting can continue, if so desired, from the injection wells towards the recovery wells.

STEP 3

Combustion of the Carbonaceous Residue and the Waste Gases

The carbonaceous residue left after the retorting is burned, together with waste gases. This step directly follows the retorting step, and takes place while the formation is already hot from retorting; so high temperatures can easily be reached. As a result, the $CaCO_3$ decomposes to form CaO, and $CO_2$. The CaO may be utilized in Step 5 below, and the $CO_2$ may be utilized in either or both of Steps 6 and 7 below.

STEP 4

Steam Generation

Water is pumped down into the hot formation, and the steam generated is recovered and used. The CaO is slaked to $Ca(OH)_2$.

STEP 5

Causticizing

Sodium carbonate solution is pumped through the spent shale and reacts with the $Ca(OH)_2$ to form NaOH and $CaCO_3$.

STEP 6

Precipitation of $Al(OH)_3$

The solution containing $NaAlO_2$, $Na_2CO_3$ and NaOH from Step 1 is treated with $CO_2$ until all the aluminate precipitates as alumina hydrate, $Al_2O_3.nH_2O$. The solid $Al_2O_3.nH_2O$ is then calcined or utilized in other ways. Part of the resulting $Na_2CO_3$ solution may be used in Step 5, and part of it may be used in Step 7 to precipitate the $NaHCO_3$.

STEP 7

Precipitation of the $NaHCO_3$

The saturated $Na_2CO_3$ solution is reacted with $CO_2$ gas until all of the $Na_2CO_3$ is converted to $NaHCO_3$. Due to the difference in the solubilities the major part of the $NaHCO_3$ precipitates as solid crystals.

STEP 8

Calcination of the $NaHCO_3$

The solid $NaHCO_3$ produced in Step 7 is heated. On heating this compound decomposes to anhydrous $Na_2CO_3$, $CO_2$ gas, and water. This is essentially the same as Step 11 in the first-described process. The $CO_2$ generated may be used in Steps 6 and 7.

DETAILED DESCRIPTION OF THE FIRST-OUTLINED PROCESS ABOVE (FIGS. 1–6)

Preparation Before the Steps

The shale deposits usually lie several hundred feet below ground. Above ground, at a suitable location, the process equipment is set in place.

Figure 5:
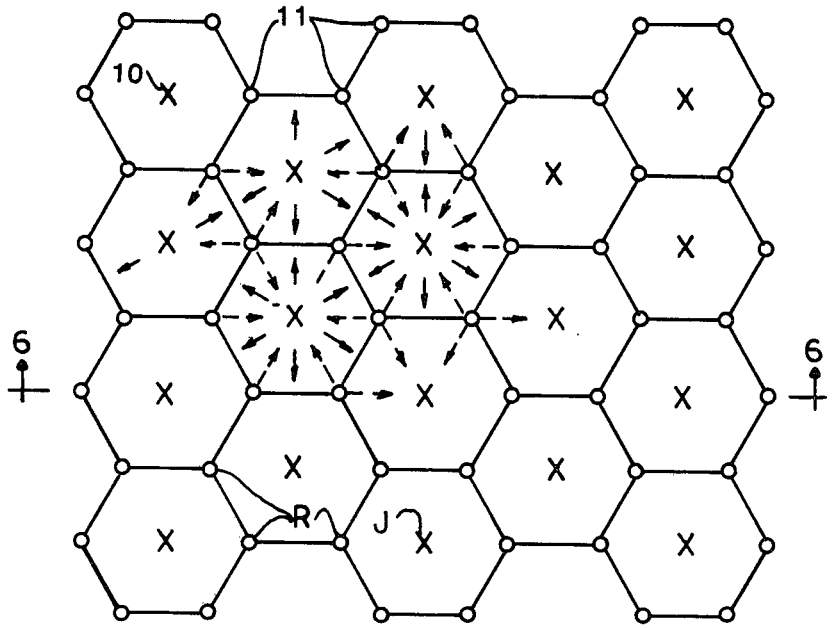
FIG. 5 is a diagrammatic view of a configuration of wells for injection and recovery of liquids; as well as for retorting and recovery of the shale.
Figure 6:
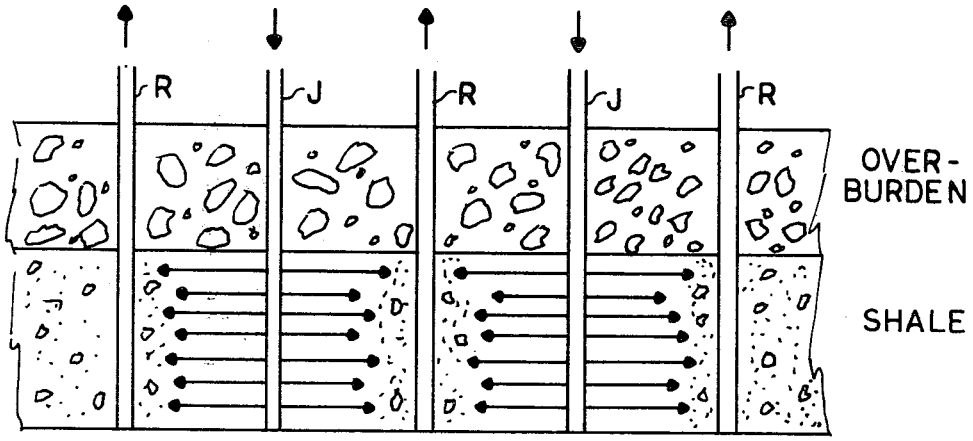
FIG. 6 is a diagrammatic view in section taken along the line 6—6 in FIG. 5.

Wells are then drilled to extend well down into the shale deposits, as shown in FIGS. 5 and 6. Recovery wells R are preferably drilled in a hexagonal pattern at suitable distances apart: i.e., from ten to one hundred feet. In the center of each hexagon an injecting well J is drilled.

Figure 1:
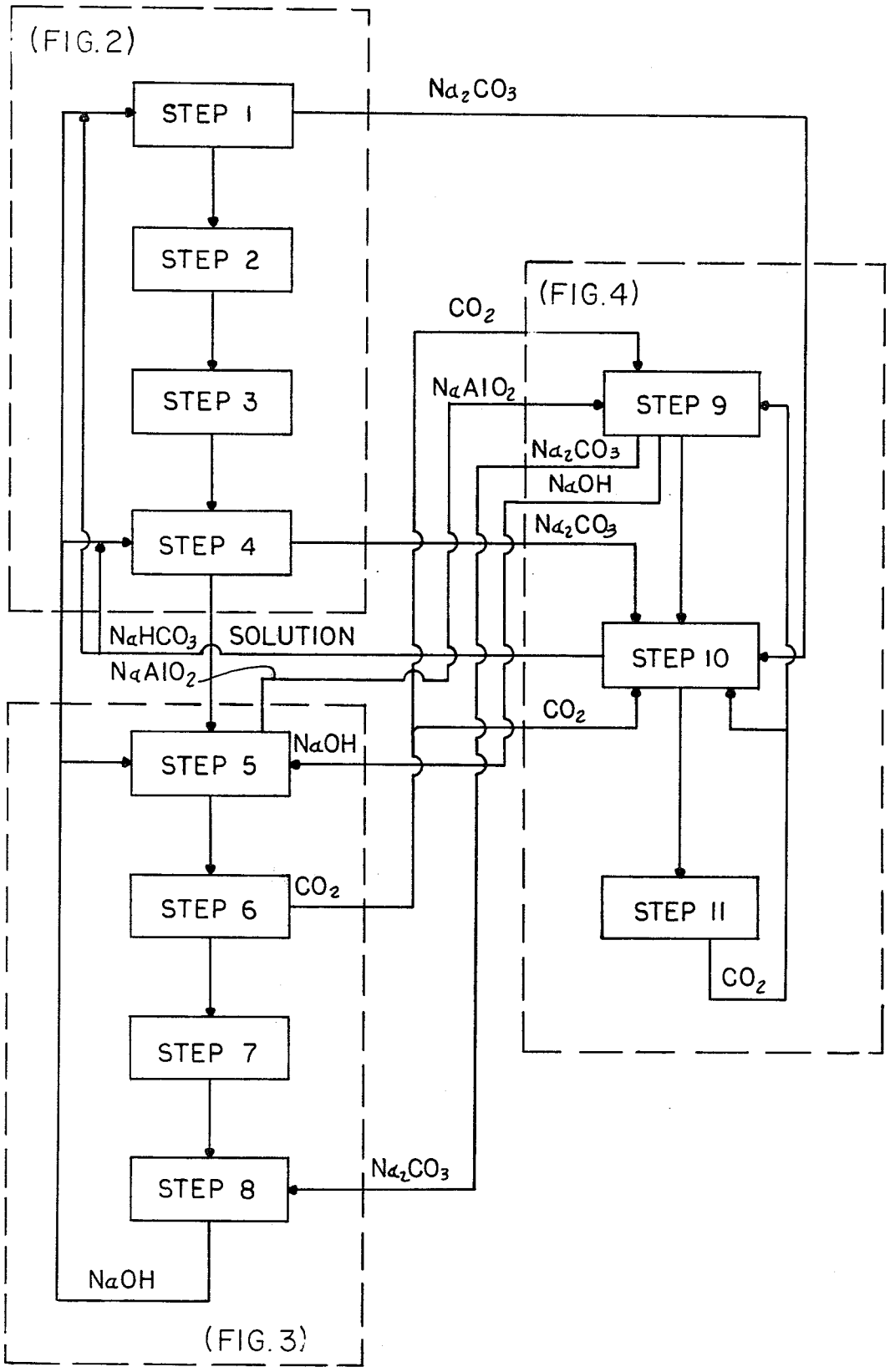
FIG. 1 is a key diagram flow sheet of a first embodiment of the principles of the invention, showing the relationships between FIGS. 2–4.
Figure 2:
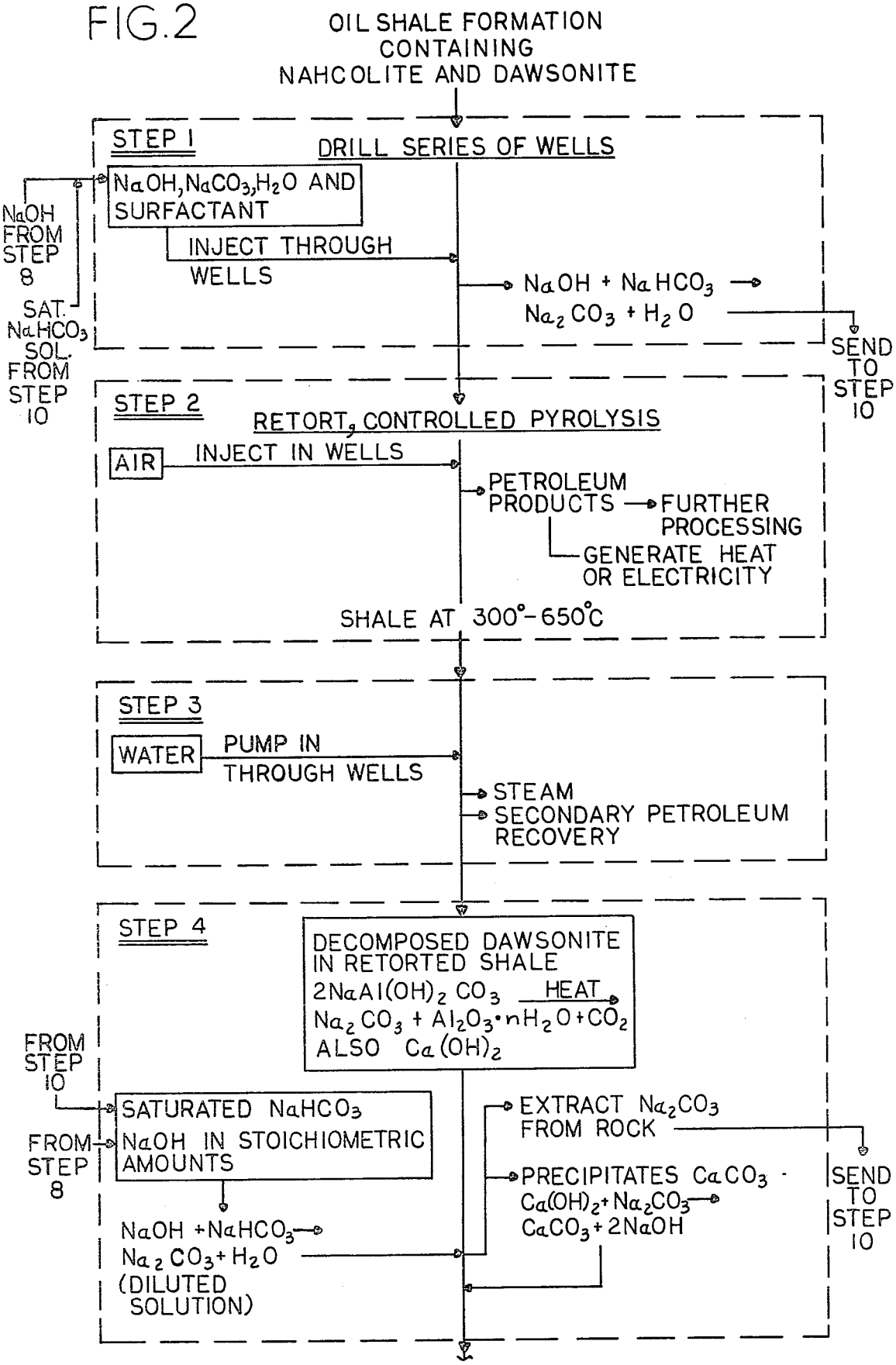
FIGS. 2, 3, and 4 comprise a flow sheet presenting that first embodiment of the process of the invention.
Figure 3:
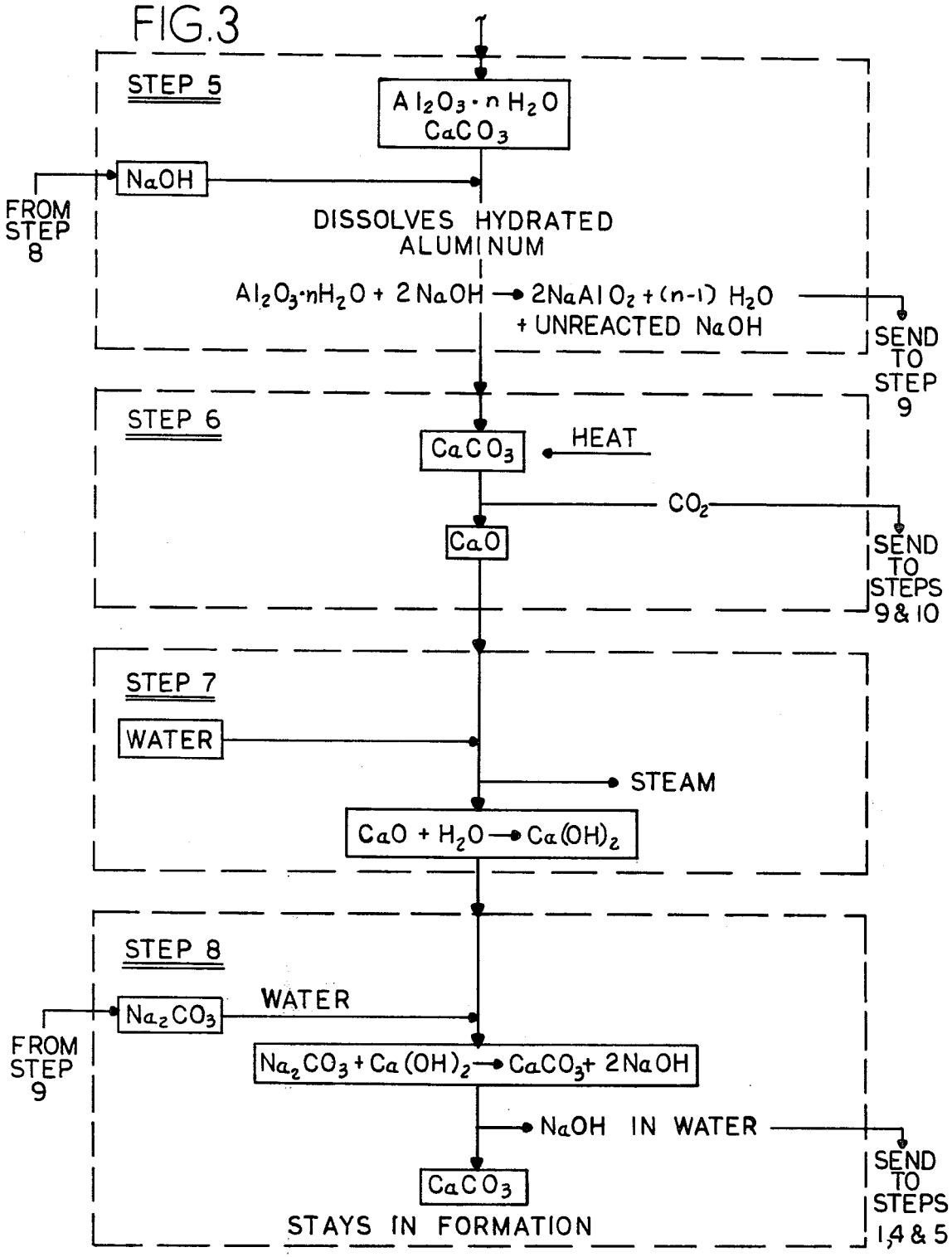
Figure 4:
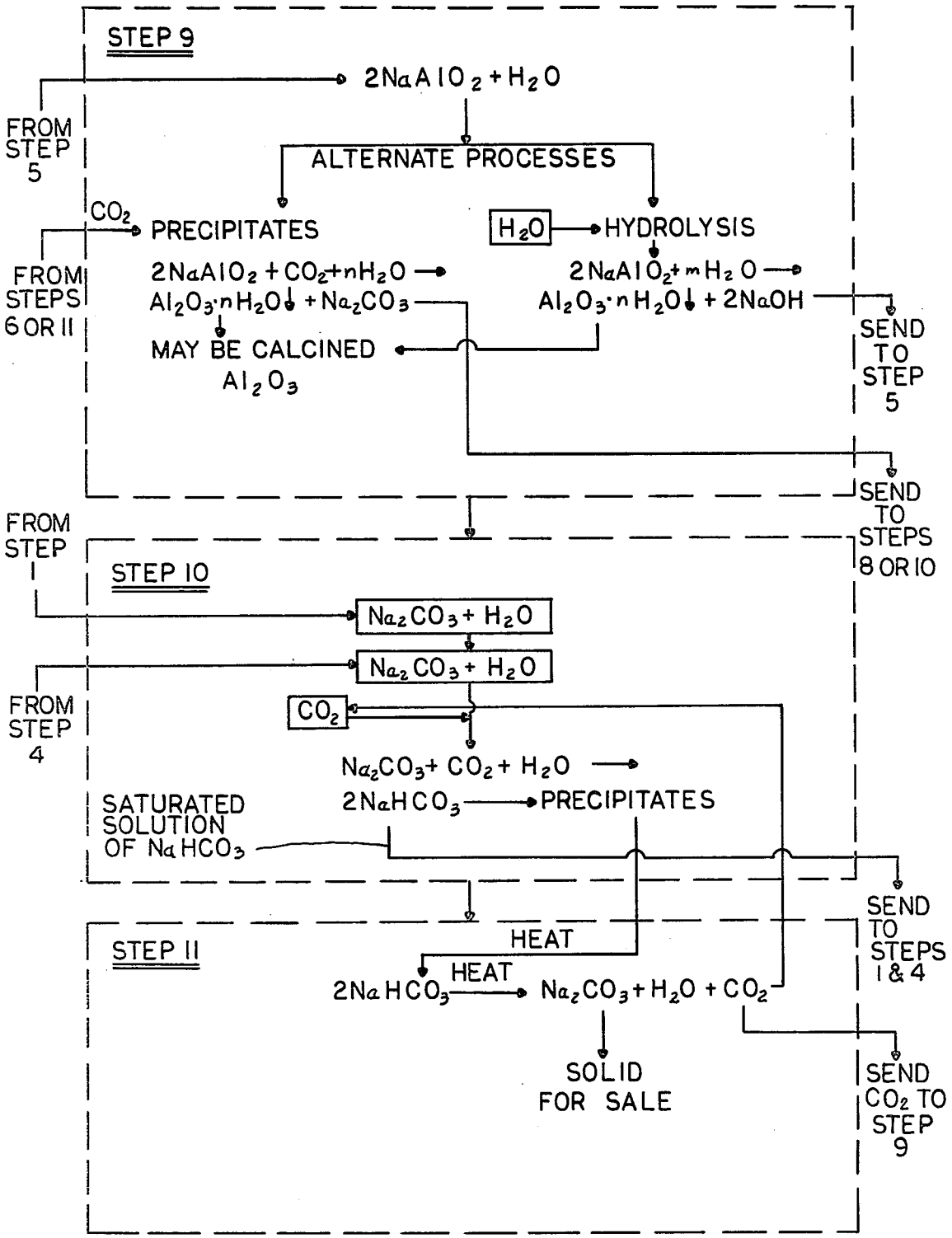

The flow sheets, FIGS. 2, 3, and 4 illustrate the process here described, while FIG. 1 shows the relationship between FIGS. 2, 3, and 4.

The process may be a continuous one, wherein a few wells are drilled and the process steps commenced. While the process steps are in progress, other wells are drilled. Eventually, it may be that many, if not all, of the steps are going on simultaneously, though in different locations. This makes it quite feasible to use NaOH from a later step in an earlier step elsewhere. At the very beginning, there will be an initial outlay for chemicals that will be produced once the process is fully in operation.

STEP 1

The Solution Mining of the Water-Soluble Minerals (FIG. 2)

The first step of the invention is applicable to oil shales containing water-soluble components, including but not limited to:

nahcolite [$NaHCO_3$]
trona [$Na_2CO_3.NaHCO_3.2H_2O$]
wegscheiderite [$Na_2CO_3.3NaHCO_3$]
thermonatrite [$Na_2CO_3.H_2O$]
halite [NaCl]
natron [$Na_2CO_3.10H_2O$]

It applies to other water-soluble compounds which are present in finely divided form, in coarse form, or are contained as large masses in the oil shale matrix.

In Step 1 (FIG. 2), the water-soluble minerals are dissolved in an aqueous solvent containing a surfactant or a combination of surfactants (also known as wetting agents), and in the case of nahcolite, and other minerals containing $NaHCO_3$, the aqueous solvent also contains caustic soda (NaOH). The NaOH must at first be supplied, but it is produced in Step 8 and may soon be used from there. The extracting liquid can be fresh water or saline water or water recirculating from other steps in the process and re-used in the extraction step, e.g. the saturated sodium bicarbonate solution from Step 10 below, in which case there must be sufficient NaOH to convert that sodium bicarbonate solution from Step 10 to $Na_2CO_3$ and also to react similarly with the nahcolite.

The surfactants can be cationic, anionic, nonionic, or zwitterionic compounds. Almost any surfactant will be effective, though not all will act equally well under all conditions. The surface tension of the extracting liquid when containing surfactant or surfactants should be considerably lower than that of the liquid not containing surfactant. The surface tension of the extracting liquid containing the wetting agent in concentrations of 0.1% or less should be 30 dynes/cm or less. The temperature of extraction may range from ambient to above the decomposition temperature of nahcolite.

The extracting solution is pumped into the shale formation through appropriately located injection wells J drilled to the depth required by the particular area, and the saturated solution is recovered through recovery wells R.

In shales of the Central Piceance Creek Basin, in Colorado, containing an average of 15% nahcolite, the void in the oil shale after the extraction of the nahcolite would be approximately 15%. This is adequate to achieve a low pressure drop across the in situ retort. In case further fracture of the shale is desired, the increased porosity caused by the dissolution of the water-soluble mineral content of the oil shale provides a convenient receptacle for the application of explosives like desensitized nitroglycerin or others.

Breakdown of the formation can also be achieved without the use of explosives. For example, the necessary pressure for hydraulic fracturing of oil shale ranges from 150 to 1500 p.s.i. The hydrostatic pressure at the bottom of a well depends on the depth of the well and the density of the liquid. Assuming diluted aqueous solutions having densities near one gram per cubic centimeter, the hydrostatic pressure at the bottom of a 2,000 ft. well is approximately 860 p.s.i., and at the bottom of a 3,000 ft. well is approximately 1,290 p.s.i., which is adequate to cause further breakdown of the formation.

Borehole mining techniques can also be used to break up the formation.

The extraction front progresses by drilling new wells in the adjoining area. Thus, after a first set of wells has been drilled, the extraction step may be begun and succeeded by other steps while new wells are being drilled. This enables the use of products and energy developed in later steps in one area to be used in the early steps of another area.

In Step 1 as here exemplified, the caustic soda (NaOH) content of the extracting liquid reacts with the nahcolite, $NaHCO_3$ to form a solution of soda ash, $Na_2CO_3$.

$$NaHCO_3 + NaOH \rightarrow Na_2CO_3 + H_2O$$

The solubility of $Na_2CO_3$ in the extracting liquid is approximately three times the solubility of the $NaHCO_3$ therein; therefore the extracting liquid can dissolve approximately three times as much of the sodium salt when the $NaHCO_3$ is converted to $Na_2CO_3$.

Above ground, the soda ash, $Na_2CO_3$, content of the essentially saturated liquid may (in Step 10 below) be reacted by saturation with $CO_2$. Solid $NaHCO_3$ then precipitates from the resulting saturated $NaHCO_3$ solution.

After replenishing the NaOH and the surfactant, the dilute $Na_2CO_3$ solution may be returned to Step 1 for further extraction of nahcolite, in the same or other locations.

STEP 2

The In-situ Retorting of the Oil Shale (FIG. 2)

In the second step of this invention the oil shale, which is essentially free of the water soluble minerals, is retorted. Controlled pyrolysis causes the kerogen content of the oil shale to decompose to oil, gas, and carbonaceous residue. The temperature of the pyrolysis is maintained between 300°-650° C., by regulating the quantity of admitted air. By mixing process gases (such as waste gases obtained in this very step) with the air, the oxygen content of the air-gas mixture can be regulated. This regulation of oxygen content also regulates the temperature to levels necessary to prevent losses of oil due to the breakdown of the oil and formation of gases caused by excessively high temperatures. The velocity of the combustion front is thereby also controlled. Also, over-heating of the dawsonite is thereby avoided so as to prevent the formation of hard-to-dissolve aluminum compounds, and to provide maximum formation or production of the desired sodium aluminate.

The air or air-gas mixture may be injected into the formation through the injection wells J, and the products, oil and gas, removed through recovery wells R for further processing or for generating heat and electricity. The wells used in Step 2 may be the same wells used in Step 1, but additional gas injection and production wells, or modification of the wells from Step 1, can be made as necessary.

The combustion front of the retorting Step 2 may progress almost immediately behind Step 1, the aqueous extraction process.

Part or all of the liquid products may be removed as gas at elevated temperature, e.g., at 500° F. to 1000° F., which condenses into liquid at the outside ambient temperature. To facilitate this process, heat exchangers may be used, and the heat can be recovered and utilized in other steps or for other purposes.

As stated above, the wells R may be drilled in a hexagonal pattern, with a well J drilled in the center of each hexagon. The center wells J are the injection wells, and through these center wells, the oxidizing gases are pumped into the formation. For example, at the six outside wells R of each hexagon which surround the central well J, the shale may be ignited, with the combustion progressing towards the central well. The oxidizing gases may be made to flow down through the central well J and out towards the outside wells R, which are the recovery wells for the hydrocarbons formed. The gaseous and the vaporized hydrocarbons are carried by the inert components of the oxidizing gases (e.g., $N_2$, $CO_2$, water). The liquid products are recovered through the same wells.

The countercurrent flow or burning backwards from the recovery wells towards the injection wells J can be employed to enlarge and open up passages between them. Once there are adequate channels and porosity for the hydrocarbon products and the products of combustion to pass easily from the injection wells J towards the recovery wells R, the retorting can be conducted in a co-current way; that is the injected gases and the combustion can progress in the same direction, from the injection wells J towards the recovery wells R.

A small fraction of the kerogen forms a solid carbonaceous residue which remains on the particles as a solid coating. This residue is essentially carbon and it is utilized in Step 6.

Another fraction of the kerogen forms combustible gases. One part of this gas is mixed with the air, to regulate the oxygen concentration, another part may be utilized at the power plant.

To enhance the oil recovery, some steam may be injected through the recovery wells during this step, if desired.

The liquid products may either be refined on the spot or shipped to a refinery. Part or all of the gases may be burned in the power plant to provide steam and electricity. The operation of this plant is essentially similar to the operation of conventional gas-fired power plants. There is, however, a difference in the feed water cycle, as will be explained below.

STEP 3

Steam Generation (FIG. 2)

After the retorting and recovery of the oil and gases in Step 2, the temperature of the retorted shale will be approximately 300°-650° C. The heat content of the spent shale can now be utilized by pumping water, which may be condensate from the power plant recycled process water, or fresh or make-up water, through injection wells J into the formation and vaporizing the water. At the same time, the temperature of the solid mass is lowered. Steam is recovered through recovery wells R and may be used in a power plant or in other steps of the process or elsewhere. It may be used directly to drive turbines or it can be used in the boiler feed. Part of the electricity generated in the power plant will be used in the other processes, part of it can be sold and a major part is used for the electrolysis of the alumina to produce aluminum metal.

In this step, apart from producing steam, the rapid cooling of the spent shale is also accomplished. Without this step, the natural cooling of the retorted shale would take too long, and the time delay between the retorting and the following extraction steps would be too long.

Steam generation also serves to provide secondary recovery of shale oil.

Due to local overheating in Step 2, some of the minerals, especially the carbonates of calcium and magnesium may decompose partially, forming the oxides of these elements. An approximate exemplary equation is:

$$CaCO_3 \rightarrow CaO + CO_2.$$

The water reacts with the CaO:

$$CaO + H_2O \rightarrow Ca(OH)_2.$$

STEP 4

The Extraction of Soda Ash (FIG. 2)

The mineral dawsonite, which is not soluble in water, was at least partly decomposed in Step 2, but over-heating was avoided. The following (not stoichiometric) equation approximates the thermal decomposition:

$$2NaAl(OH)_2CO_3 \rightarrow Na_2CO_3 + Al_2O_3.nH_2O + CO_2.$$

Of the reaction products, $Na_2CO_3$ is water soluble, the $H_2O$ is liquid, the $CO_2$ is a gas, and the $Al_2O_3.nH_2O$ is a solid that is soluble in strongly alkaline solutions. The formed hydrated alumina is essentially insoluble in $Na_2CO_3$ solution; therefore, the soda ash can be dissolved with aqueous solvent without dissolving the alumina.

For the dissolution of the $Na_2CO_3$ a saturated $NaHCO_3$ solution may be used from Step 10. The stoichiometric amount of NaOH is added to this solution, which forms $Na_2CO_3$ with the $NaHCO_3$ according to the approximate equation:

$$NaHCO_3 + NaOH \rightarrow Na_2CO_3 + H_2O.$$

This dilute $Na_2CO_3$ solution is pumped down into the formation where it will dissolve further $Na_2CO_3$ until it is saturated. This saturated solution is to be treated with $CO_2$ in Step 10 below.

The saturated $NaHCO_3$ solution obtained may be used, after the addition of the necessary NaOH, in Step 1 to dissolve nahcolite and in Step 4 to dissolve the soda ash.

$Na_2CO_3$ also reacts with any $Ca(OH)_2$ which may have formed in Step 3:

$$Ca(OH)_2 + Na_2CO_3 \rightarrow CaCO_3 + 2NaOH.$$

The $CaCO_3$ formed is insoluble in alkalis, therefore it cannot react with the alkaline alumina solution. This fact eliminates the losses by preventing the formation of insoluble Ca—Al compounds.

STEP 5

The Extraction of the Alumina [$Al_2O_3$] (*FIG. 3*)

In Step 2 above, the mineral dawsonite decomposed into two main components, hydrated alumina, $Al_2O_3.nH_2O$, and soda ash, $Na_2CO_3$. When the $Na_2CO_3$ was dissolved in Step 4, the hydrated alumina, which is essentially insoluble in soda ash solution, remained in place. The hydrated alumina corresponds approximately to boehmite, $Al_2O_3.H_2O$ or gibbsite, $Al_2O_3.3H_2O$.

A solution of caustic soda, NaOH is now used in excess to dissolve the hydrated alumina according to the approximate equation:

$$Al_2O_3.nH_2O + 2NaOH \rightarrow 2NaAlO_2 + (n-1)H_2O.$$

From the aluminate solution, which also contains unreacted NaOH, the alumina is precipitated in Step 9, below.

In order to facilitate the alumina recovery, a $Na_2O$ to $Al_2O_3$ mole ratio of 1.5 to 3 is used. The temperature of the formation at the extraction should be between 100° C. and 250° C. Whenever the temperature is higher than the boiling point of the extracting liquid under the conditions of the extraction, the process is conducted under pressure to prevent vaporization.

STEP 6

Combustion of the Carbonaceous Residue and Waste Gases (FIG. 3)

In Step 2 the kerogen contained in the oil shale was pyrolyzed to oil, gas, and a solid residue. When the oil and gas were recovered, the solid carbonaceous residue remained in the place where it formed. In parts of the process, especially in Step 2, carbonaceous gases are formed which have low heating value and are therefore not suitable for applications requiring high-heating-value gases. These gases can be disposed of by burning them underground together. With the carbonaceous residue, after the decomposition products of dawsonite (i.e., the soda ash and alumina) have been extracted. The same wells R and J used in the previous steps can be used for the injection of the gases and the venting of the gaseous products of combustion, or new wells can be added as needed.

The heat generated during the combustion in this step decomposes the carbonate minerals of the spent shale according to the approximate equation:

$$CaCO_3 \rightarrow CaO + CO_2.$$

The $CO_2$ is a gas and it is or can be used in Steps 9 and 10. A usable waste product is CO.

The CaO is solid and it is or can be utilized in Step 8.

STEP 7

Steam Generation (FIG. 3)

In Step 6 the carbonaceous residue from the thermal decomposition of the kerogen and the low-heating-value discharge gases from the processes were burned underground. Water from the processes or fresh make-up water is then pumped into the formation through injection wells J. The water is vaporized and is recovered as steam through recovery wells R. The CaO which was formed in Step 6 reacts with (is slaked by) the water according to the approximate equation:

$$CaO + H_2O \rightarrow Ca(OH)_2.$$

This $Ca(OH)_2$ will be further treated in Step 8, and the steam may be used in the power plant and in other process steps.

STEP 8

Production of Caustic Soda (FIG. 3)

When soda ash solution and slaked lime, $Ca(OH)_2$, react, caustic soda, NaOH, and calcium carbonate, $CaCO_3$, are formed. In this invention, soda ash is obtained from the nahcolite in Step 1 and also as one of the products of recovery of the alumina, $Al_2O_3$, in Step 4, above, and, still later in Step 9, in the alumina recovery by precipitation with carbon dioxide. It also occurs in dissolved state in the natural ground waters.

Soda ash solution is pumped through the burned spent shale after Step 6, and the following approximate reaction takes place:

$$Ca(OH)_2 + Na_2CO_3 + H_2O \rightarrow CaCO_3 + 2NaOH.$$

The resulting caustic soda is in solution and is pumped to the surface, for use in Step 1, Step 4, Step 5, or elsewhere. The calcium carbonate, $CaCO_3$ formed is solid and is insoluble in water. This solid $CaCO_3$ forms a strong mortar-like material, which, together with the other solid residue, is sufficient to prevent the settling of the overburden.

An evaporator may be used to concentrate the caustic soda solution obtained in Step 8, since that step produces a relatively dilute, e.g., 10 to 20% aqueous solution, of NaOH. For some parts of the process, to avoid undue dilution of the process liquid and to conserve water, the concentration of the diluted NaOH solution is advisable.

STEP 9

The Recovery of the Alumina ($Al_2O_3$) (FIG. 4)

The sodium aluminate solution which is obtained and pumped to the surface in Step 5, above, is treated in Step 9 to enable recovery of the aluminum values. To do this, hydrated alumina can be precipitated from the solution by hydrolysis or by precipitation with carbon dioxide.

In case of the hydrolysis, the sodium aluminate solution is seeded with fine alumina hydrate, and the precipitation of the dissolved aluminate takes place upon agitation of the mixture. Agitation can be accomplished by mechanical stirrers or, preferably, by bubbling air through the solution while confining the solution in a vertical cylindrical container. The approximate reaction of the hydrolysis is:

$$2NaAlO_2 + mH_2O \rightarrow Al_2O_3.nH_2O + 2NaOH.$$

The caustic soda, NaOH, is regenerated in this step, and it can be re-used in Step 5 for the extraction of the alumina.

When the recovery of $Al_2O_3$ is to be accomplished by the precipitation method, using carbon dioxide, the $CO_2$ may be obtained from Step 6, from Step 11, or from the combustion processes employed in the operation. The approximate reaction is:

$$2NaAlO_2 + CO_2 + nH_2O \rightarrow Al_2O_3.nH_2O + Na_2CO_3.$$

The hydrated alumina, $Al_2O_3.nH_2O$ is then separated from the solution; it can be calcined to alumina $Al_2O_3$.

The $Al_2O_3$ precipitates in a hydrated form as either $Al_2O_3.3H_2O$ similar to gibbsite, or $Al_2O_3.H_2O$ similar to boehmite, or a mixture of them, depending on the conditions. This hydrated alumina is one of the valuable byproducts of this process. It can be marketed as is, can be processed to yield activated alumina, or can be calcined to give $Al_2O_3$, which is the basic material for the electrolitic production of aluminum metal.

The alumina hydrate from Step 9 may be treated to produce different grades of activated alumina which can be used in the different plants to reduce or eliminate pollution or can be marketed.

Alternatively, the alumina hydrate obtained in Step 9 may be converted into anhydrous alumina [$Al_2O_3$]. This compound is the raw material form of the electrolitic production of aluminum and it may be utilized in an aluminum electolysis plant or marketed. Either on site, or elsewhere, metallic aluminum may be recovered by the electrolytic decomposition of the alumina. The electrical power necessary may be supplied by the power plant. The aluminum metal may be marketed or processed into semi-finished products.

The $Na_2CO_3$ solution can be used either in Step 8 to regenerate the NaOH, or in Step 10 to produce high purity $NaHCO_3$.

STEP 10

Precipitation of the $NaHCO_3$ (FIG. 4)

From Steps 1 and 4 a solution is obtained which is essentially saturated with soda ash, $Na_2CO_3$. In order to re-use this liquid, some or all of its $Na_2CO_3$ content should be removed. The removal of the dissolved solid by evaporation and crystallization would require a large quantity of heat. However, due to the different solubilities of $Na_2CO_3$ and $NaHCO_3$, the removal of the soda ash can be achieved by the carbonation of the solution, without consuming the large amount of heat necessary for evaporation and crystallization. For this purpose, the soda ash is reacted with carbon dioxide to form, sodium bicarbonate, which, due to its lower solubility, precipitates as solid crystals, leaving a saturated solution of sodium bicarbonate, which can be mixed with the sodium hydroxide from Step 8 and then sent to Steps 1 and 4. Thus, the $NaHCO_3$ from the nahcolite in Step 1, and the $Na_2CO_3$ from the decomposition of the dawsonite in Step 4, can be recovered in solid form.

Also, the solutions from Steps 1 and 4 are saturated with $Na_2CO_3$.

STEP 11

Calcination of the $NaHCO_3$ (FIG. 4)

The solid $NaHCO_3$ produced in Step 10 is now heated to decompose it to $Na_2CO_3$ and to $CO_2$. The approximate equation is:

$$2NaHCO_3 \xrightarrow{heat} Na_2CO_3 + H_2O + CO_2.$$

The $CO_2$ may be used in Step 10 to precipitate $NaHCO_3$. The $Na_2CO_3$ is solid and it can be marketed as is.

PRODUCTS OF THE PROCESS OF FIGS. 1-4

The following products may be obtained by the process:

1. Oil

Liquid hydrocarbons are the main products of the process. After recovering the oil in Step 2, it is treated further to obtain the usually marketed fractions such as gasoline, diesel oil, heating oil, lubricants, etc.

2. Electricity

Electrical energy may be produced in the power plant using the gases from Step 2 and the steam from Steps 3 and 7. Excess electricity can be sold to utility companies for use in their electricity distribution network.

3. Caustic Soda

Solid NaOH may be produced by evaporation from the diluted solution from Step 8. It can be marketed as a 50% solution. For this product, the evaporation is conducted in such a way that it will yield a 50% NaOH solution.

4. Alumina

Different grades of activated alumina can be produced from the alumina hydrate obtained in Step 9. Alternatively after washing and drying, the precipitated alumina hydrate obtained in Step 9, can be marketed as is.

Essentially pure $Al_2O_3$ may be obtained by the high temperature calcining of the alumina hydrate from Step 9. This is the basic raw material for the electrolytic production of metallic aluminum. Some of it may be used to produce aluminum utilizing the electricity supplied by the power plant. The rest can be marketed as is.

5. Aluminum

Aluminum is produced by electrolysis, from the alumina. It can be marketed as aluminum ingot or can be further processed to alloys, casting, sheets, rods, extrusions, etc.

6. Sodium Bicarbonate

Sodium bicarbonate occurs in the oil shale as the mineral nahcolite. In this invention it may be recovered as essentially pure $NaHCO_3$ in Step 10. Some of it will be marketed after drying.

7. Soda Ash

Essentially pure $Na_2CO_3$ is obtained in Step 11 by the thermal decomposition of the $NaHCO_3$ precipitated in Step 10. It can be marketed as is.

EXAMPLE 1

When 1 short ton (2000 pounds) of shale containing 20 gallons per ton of recoverable oil, 15% nahcolite and 11% dawsonite is extracted and retorted, according to the process just described, it can be expected to yield the following products:

From the kerogen:
20 gallons of oil
From the dawsonite:
78.0 pounds alumina [$Al_2O_3$]
or 41.2 pounds aluminum
or any combination of the two.
124.4 pounds sodium bicarbonate [$NaHCO_3$]
or 81.0 pounds soda ash [$Na_2CO_3$]
or 61.2 pounds caustic soda [NaOH]
or any combination of them.
From the nahcolite:
300 pounds sodium bicarbonate
or 188.8 pounds soda ash
or 142.8 pounds caustic soda
or any combination of them.
The total minerals to be recovered from the dawsonite and nahcolite are:
78.0 pounds alumina [$Al_2O_3$]
or 41.2 pounds aluminum
or any combination of the two.
428.4 pounds sodium bicarbonate [$NaHCO_3$]
or 290.2 pounds soda ash [$Na_2CO_3$]
or 204.0 pounds caustic soda [NaOH]
or any combination of the three.

EXAMPLE 2

The thickness of oil shale in some areas of the Central Piceance Creek Basin in Colorado is typically 600 feet, covered by approximately 1200 feet of overburden. A typical shale bed contains:
26 gallons per ton of recoverable oil,
15% nahcolite, and
11% dawsonite.
When *one acre* of the shale is processed in situ in accordance with the process just described, the oil and minerals expected to be recovered are as follows:
1,010,295 barrels of oil per acre
70,057 short tons of alumina [$Al_2O_3$]
or 37,090 short tons of aluminum
or any combination of the two.
384,028 short tons of sodium bicarbonate [$NaHCO_3$]
or 242,303 short tons of soda ash [$Na_2CO_3$]
or 182,871 short tons of caustic soda [NaOH]
or any combination of the three.

DETAILED DESCRIPTION OF THE SECOND-OUTLINED PROCESS ABOVE (FIGS. 7 AND 8)

In this alternative process, which is somewhat more compact, the same kind of well pattern is used and basically the same procedure followed, except where noted.

STEP 1

Figure 7:
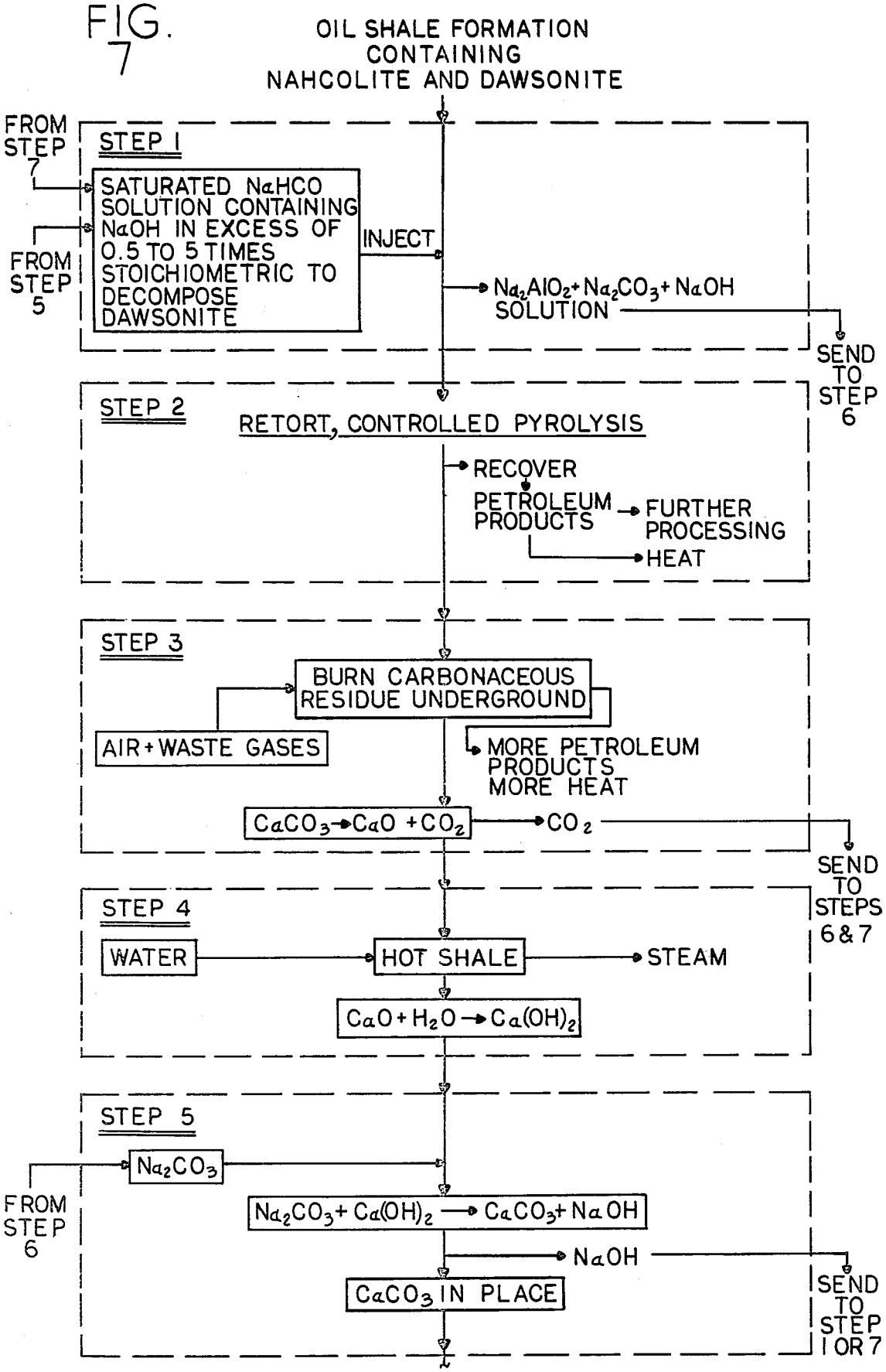
FIG. 7 is a flow sheet showing about half of the process of a second embodiment of the principles of the invention.

Extraction of Nahcolite and Dawsonite (FIG. 7)

In Step 1 of this alternative process, both the nahcolite and dawsonite contents of the oil shale are dissolved. The solvent used is a saturated $NaHCO_3$ solution, which may be obtained from Step 7, once the process is in full operation, containing free caustic soda (NaOH) and a surfactant or a combination of surfactants. The free NaOH reacts with the dawsonite according to the approximate equation:

$$NaAl(OH)_2CO_3 + 2NaOH \rightarrow NaAlO_2 + Na_2CO_3 + 2H_2O.$$

The solid dawsonite thus reacts with the dissolved NaOH and forms sodium aluminate and soda ash as the main products. These products are water soluble, and they are contained in the aqueous solution.

The solution for the extraction also contains a sufficient amount of NaOH to react with the $NaHCO_3$ content of the solution and to react with the nahcolite to form soda ash:

$$NaHCO_3 + NaOH \rightarrow Na_2CO_3 + H_2O.$$

The quantity of the NaOH is so chosen that after its reaction with the dawsonite, with the free $NaHCO_3$, and with the nahcolite, an excess amount of free NaOH still remains in the solution. The excess NaOH is 0.5 to 5 times the stoichiometric equivalent of the NaOH necessary for the decomposition of dawsonite. That is, the molecular ratio of NaOH to dawsonite should be between approximately 3 and 10, plus the NaOH needed for the reaction with the nahcolite and the free $NaHCO_3$.

The extracting solution is pumped down through injection wells J, and it is recovered through recovery wells R. The porosity of the shale after the extraction will be approximately 20–25% by volume.

STEP 2

Retorting (FIG. 7)

In Step 2, the solid kerogen content of the oil shale is decomposed to liquid and gaseous products and to a solid carbon residue, which remains in place after the recovery of the liquid and gaseous product. Part or all of the liquid products may be removed as gas at elevated temperatures, 500° F. to 1000° F., and this gas condenses into a liquid at the outside ambient temperature. To facilitate this process, heat exchangers may be used, and the heat can be recovered and utilized.

Since the shale formation contained dawsonite and nahcolite (or some other water-soluble or alkali-soluble minerals) and since they were removed in Step 1, the formation has a porosity equal to the volume of the minerals dissolved in Step 1. Either this porosity which was caused by the dissolution of the minerals or the natural porosity and fissures of the formation may provide the channels for the flow of oxidizing gases and the hydrocarbon products.

As stated above, the wells R may be drilled in a hexagonal pattern, with wells J in the center of each hexagon. The center wells J are the injection wells. Through these center wells J, oxidizing gases (oxygen, air, air-oxygen mixture, or air-combustion gas mixture) are pumped into the formation. The purpose of the mixing of the gases (air-combustion gas) is that the oxygen content of the mixture be controlled, which, in turn, regulates the conditions of combustion, such as the velocity of the combustion front and its temperature.

At the six outside wells R of each hexagon which surround the central well J, the shale is ignited, and the combustion progresses towards the central well J. The oxidizing gases flow through the central well J towards the outside wells R, which are the recovery wells for the hydrocarbons formed. The gaseous and the vaporized hydrocarbons are carried by the inert components of the oxidizing gases (e.g., $N_2$, $CO_2$, water). The liquid products are recovered through the same wells.

Burning backwards from the recovery wells towards the injection wells can be employed to enlarge and open up passages between them. Once there are adequate channels and porosity for the hydrocarbon products and the products of combustion to pass easily from the injection wells towards the recovery wells, the retorting can be conducted in a cocurrent way; that is the injected gases and the combustion can progress in the same direction, from the injection wells towards the recovery wells.

To enhance the oil recovery, steam may be injected through the injection wells.

The liquid products may either be refined on site or shipped to a refinery. Part or all of the gases may be burned in the power plant to provide steam and electricity.

STEP 3

Combustion of the Carbonaceous Residue and Waste Gases (FIG. 7)

In Step 3 the carbonaceous residue from the decomposition of the kerogen in Step 2 and the low-heating-value waste gases are burned underground. The oxidizing gases (e.g., air, or oxygen) and the waste gases are pumped down through the injection wells J. The wells may be the same as in the previous steps, or new wells can be added as needed. As before, one waste gas may be CO from the burning.

The temperature of the already hot formation increases further. At the elevated temperature the calcite decomposes according to the approximate equation:

$$CaCO_3 \rightarrow CaO + CO_2.$$

The CaO formed may be utilized in Step 5 below and part of $Co_2$ of the combustion may be utilized in Steps 6 or 7 below.

STEP 4

Steam Generation (FIG. 7)

In Step 3 the carbonaceous residue from the thermal decomposition of the kerogen and the low heating value discharge gases from the processes were burned underground. In Step 4, water from the processes or fresh make-up water is pumped down into the formation. The water vaporizes and is recovered as steam through recovery wells.

The CaO which formed in Step 3 is slaked by the water according to the approximate equation:

$$CaO + H_2O \rightarrow Ca(OH)_2.$$

This $Ca(OH)_2$ may be utilized in Step 5 below, and the steam may be used in the power plant and otherwise in the processes.

Due to the high temperature of the formation which was reached by the combustion of the carbonaceous residue and the waste gases directly following the retorting step in an already high-temperature formation, the steam generated may be at a high temperature and pressure. The maximum temperature which can be reached is the temperature of the formation. The maximum pressure which can be reached is limited by the thickness and specific gravity of the overburden.

In a typical case, with a 1200 foot overburden and a specific gravity of approximately 2 grams per cubic centimeter, the maximum steam pressure is approximately 1000 p.s.i.

STEP 5

Production of Caustic Soda (Causticizing) (FIG. 7)

When soda ash solution and slaked lime ($Ca(OH)_2$) react, caustic soda (NaOH) and calcium carbonate ($CaCO_3$) form. In this process, soda ash is obtained by the decomposition of the dawsonite, or from the nahcolite, or as one of the products of the recovery of alumina by precipitation with carbon dioxide, or it may occur in dissolved state in the natural ground waters. When the soda ash solution is pumped through the burned spent shale in the following approximate reaction takes place:

$$Ca(OH)_2+Na_2CO_3 \rightarrow CaCO_3+2NaOH.$$

The resulting caustic soda is in solution and is pumped to the surface; the calcium carbonate formed is solid and insoluble in water. This solid $CaCO_3$ forms a strong mortar-like material. This structure, together with the other solid residue, is sufficient to prevent settling of the overburden.

STEP 6

Figure 8:
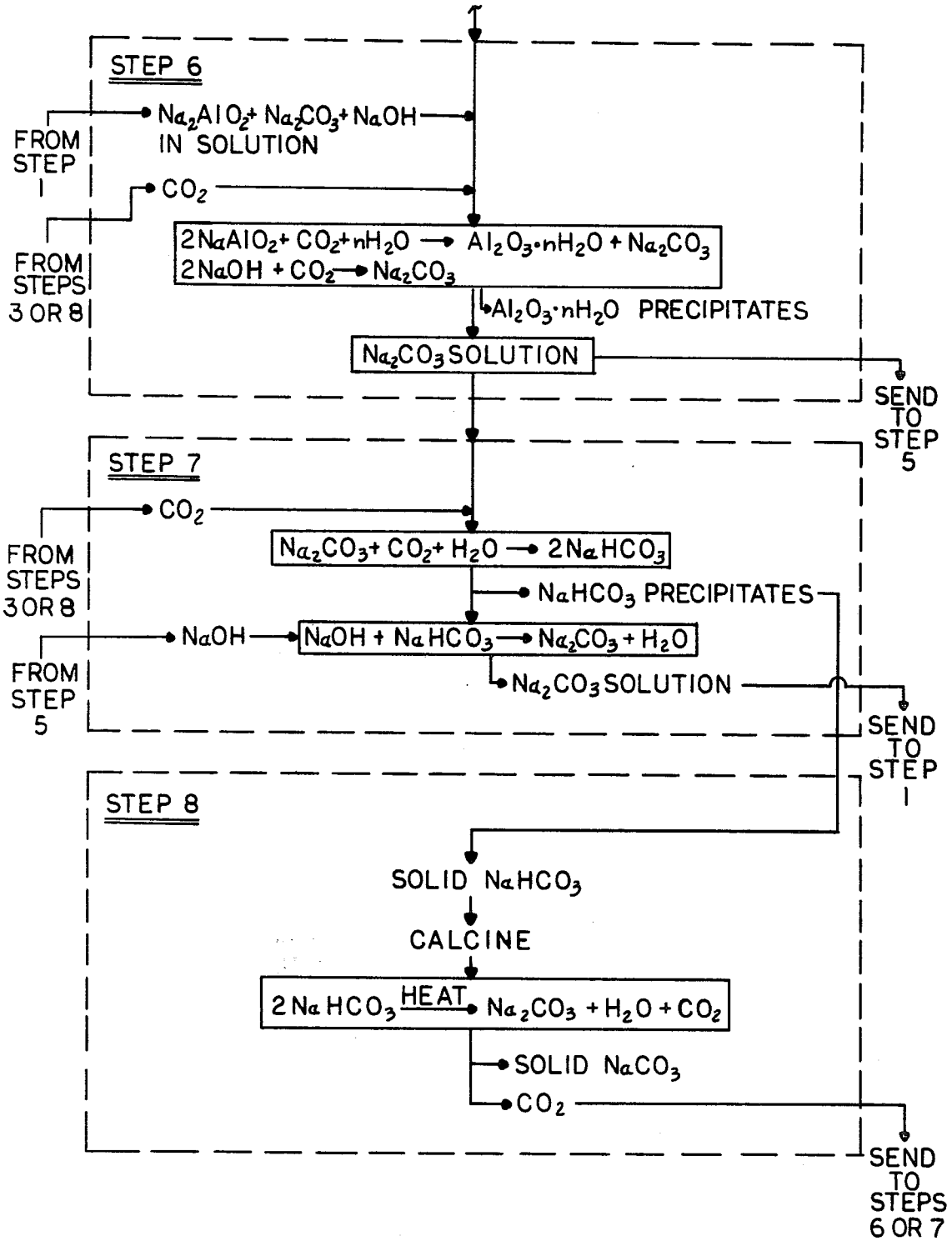
FIG. 8 is a flow sheet showing the other half of the process shown in FIG. 7.

The Recovery of the Alumina (FIG. 8)

In this step, the solution from Step 1 is treated with $CO_2$ gas to precipitate only the alumina hydrate ($Al_2O_3.nH_2O$). The $CO_2$ gas may be that obtained from Step 3 above or Step 8 below. The solution contains the dissolved nahcolite as $Na_2CO_3$, the decomposition products of dawsonite as $Na_2CO_3$ and $NaAlO_2$, and free NaOH, which is necessary to keep the Na-aluminate ($NaAlO_2$) in solution. The $CO_2$ added to this solution is just sufficient to react with the free NaOH and with the $NaAlO_2$ to achieve a quantitative precipitation of the aluminum values. The approximate equations are:

$$2NaOH+CO_2 \rightarrow Na_2CO_3+H_2O$$

$$2NaAlO_2+CO_2+nH_2O \rightarrow Al_2O_3.nH_2O+Na_2CO_3.$$

The hydrated alumina ($Al_2O_3.nH_2O$) is a solid material which is separated from the solution and after washing can be calcined to alumina ($Al_2O_3$).

The remaining $Na_2CO_3$ solution may be used in Step 5, to produce caustic soda and in Step 7 below to precipitate $NaHCO_3$ from it.

STEP 7

Precipitation of the $NaHCO_3$ (FIG. 8)

In Step 6 a solution was obtained which is essentially saturated with soda ash. In order to re-use this liquid, all or part of its $Na_2CO_3$ content has to be removed. The removal of the dissolved solid by methods such as evaporation or direct crystallization requires a large quantity of heat.

However, based on the different solubilities of $Na_2CO_3$ and $NaHCO_3$, the removal of the soda ash can be achieved by the carbonation of the solution, without consuming the large amount of heat necessary for evaporation or direct crystallization. When soda ash and carbon dioxide react, sodium bicarbonate forms, and, due to its lower solubility precipitates as solid crystals.

In this step the $NaHCO_3$ from the nahcolite (Step 1), and the $Na_2CO_3$ from the decomposition of the dawsonite (Step 1) may be recovered in solid form, as $NaHCO_3$.

The solution from Step 6, where the alumina is removed by precipitation is saturated with $Na_2CO_3$. $CO_2$ gas from Steps 3 and 8 is then absorbed in the liquids. The $NaCO_3$, $CO_2$ gas and water react according to the equation:

$$NaCO_3+CO_2+H_2O \rightarrow 2NaHCO_3.$$

The saturated soda solution contains approximately 45 parts $Na_2CO_3$ in 100 parts water, and the saturated sodium bicarbonate solution contains approximately 16 parts $NaHCO_3$ in 100 parts $H_2O$. Due to this difference in the solubilities when soda solution is treated with $CO_2$ gas, the major part of the $NaHCO_3$ formed in the reaction precipitates as solid crystals, and the remaining aqueous solution is saturated with $NaHCO_3$.

After the precipitation, the saturated $NaHCO_3$ solution contains approximately 16 parts $NaHCO_3$ in 100 parts water. The stoichiometric equivalent of this 16 parts $NaHCO_3$ if expressed as $Na_2CO_3$ is 10 parts $Na_2CO_3$ in 100 parts of water. This means that by the $CO_2$ gas precipitation out of the 45 parts $Na_2CO_3$ in 100 parts of water, 35 parts $Na_2CO_3$ is removed. This is approximately 77% of the $Na_2CO_3$ content of the saturated solution. After the precipitation, the saturated solution contains approximately 23% of the original $Na_2CO_3$ as saturated $NaHCO_3$. This saturated $NaHCO_3$ solution is used, after adding the necessary NaOH to it, in Step 1 to dissolve the nahcolite and to decompose the dawsonite and dissolve it as $Na_2CO_3$ and $NaAlO_2$.

The solid $NaHCO_3$ can be marketed as is, or it can be converted to soda ash ($NaCO_3$) in Step 8.

STEP 8

Calcination of the $NaHCO_3$

The solid $NaHCO_3$ produced in Step 7 is heated in Step 8, and it decomposes to $Na_2CO_3$ and to $CO_2$. The approximate equation is:

$$2NaHCO_3 \xrightarrow{heat} Na_2CO_3 + H_2O + CO_2.$$

The $CO_2$ may be used in Step 6 to precipitate the alumina-hydrate or in Step 7 to precipitate the $NaHCO_3$.

The $Na_2CO_3$ is solid and it can be marketed as is.

EXAMPLE 3

Material balance for minerals recovered other than oil for one short ton of oil shale Assume that the oil shale contains 15% (wt) nahcolite and 11% (wt) dawsonite, which is approximately average for the formation in question.

The signs [+ or −] in the table below indicate that the quantity of the particular compound it refers to, is added [+] or removed [recovered] [−] in that particular step. In Step 6 for $Al_2O_3$ both signs appear in the table together [+ −], indicating that $Al_2O_3$ was added [+] in this step [as Na-aluminate] and $Al_2O_3$ was recovered [−] as alumina hydrate. In Step 6 for $Na_2CO_3$ both signs also appear together [+ −]. The solution entering into Step 6 contained $Na_2CO_3$ [+] which was recovered unchanged [−] in the solution leaving the process. An extra amount of $Na_2CO_3$ is recovered [−] in this step, which is formed by the $CO_2$ precipitation of Na-aluminate. The bracket [ ] in Step 3 means that only as much $CO_2$ was recovered from Step 3 as was needed for use in Steps 6 and 7.

In Step 1, NaOH is added [+], but part of it does not react. It only provides the excess NaOH necessary to keep the aluminate in solution. This excess NaOH is recovered [−] unchanged in this step.

TABLE

| Material balance for recovery of inorganic minerals | | | | | |
|---|---|---|---|---|---|
| STEP | $Na_2CO_3$ | $NaHCO_3$ | NaOH | $CO_2$ | $Al_2O_3$ |
| 1 | −833.8 | +296.4 | +406.4<br>−122.2 | | −78.0 |
| 2 | | | | | |
| 3 | | | | [−144.8] | |
| 4 | | | | | |
| 5 | +538.4 | | −406.4 | | |
| 6 | +−833.8<br>−162.0 | | +122.2 | +67.2 | +−78.0 |
| 7 | +457.4 | −725.0 | | +189.8 | |
| 8 | −270.4 | +428.6 | | −112.2 | |
| NET CHANGE | −270.4 | 0 | 0 | 0 | −78.0 |

+ = added in the step
− = removed in the step

Net change denotes the materials in pounds which are recovered [−] from one short ton of shale of above composition.

To those skilled in the art to which this invention relates, many changes in construction and widely differing embodiments and applications of the invention will suggest themselves without departing from the spirit and scope of the invention. The disclosures and the description herein are purely illustrative and are not inteded to be in any sense limiting.

I claim:

1. A process for obtaining useful products from an oil shale formation including intermixed nahcolite and dawsonite comprising the following steps:

(1) drilling a series of wells into said formation from aboveground, (2) injecting into said formation through some of said wells an aqueous solution of sodium hydroxide containing a surfactant, so that the sodium hydroxide reacts with the nahcolite to yield sodium carbonate and water, as a sodium carbonate solution.

(3) withdrawing the sodium carbonate solution through other said wells for further processing, and drying the formation, (4) thereafter retorting with controlled pyrolysis the shale in situ, while sending air in controlled amounts down some of said wells, and recovering petroleum products up through other said wells, and (5) thereafter sending water through some of said wells into the retorted formation to produce steam and recovering the steam through other said wells.

2. The process of claim 1, including also reacting the dawsonite to form sodium aluminate and withdrawing the sodium aluminate in solution through some of said wells.

3. The process of claim 2 wherein the reaction of the dawsonite takes place after the retorting step.

4. The process of claim 2 wherein the reacting of the dawsonite is done simultaneously with the reacting of the nahcolite.

5. The process of claim 2 in which there is the additional step of hydrolyzing the sodium aluminate aboveground to precipitate hydrated alumina and sodium hydroxide.

6. The process of claim 2 in which there is the additional step of adding $CO_2$ to the sodium aluminate solution above ground to precipitate hydrated alumina and yield sodium carbonate.

7. The process of claim 6 having the additional step of calcining the hydrated alumina.

8. The process of claim 6 in which there is the additional step of adding carbon dioxide to the recovered sodium carbonate aboveground to precipitate sodium bicarbonate.

9. The process of claim 1 in which there is the additional step of adding carbon dioxide aboveground to the recovered sodium carbonate to precipitate sodium bicarbonate.

10. The process of claim 9 including the additional step of heating the precipitated sodium bicarbonate to dry it and to form solid sodium carbonate.

11. The process of claim 1 including also, converting calcium carbonate in said formation to calcium oxide, slaking it in situ, and then returning some of the sodium carbonate in water solution via some of said wells to the calcium hydroxide to yield calcium carbonate and sodium hydroxide in situ, and withdrawing said sodium hydroxide.

12. The process of claim 1 having the step between steps (3) and (4) of enlarging the voids in the formation created by removal of the sodium carbonate solution.

13. A process for obtaining useful products from an oil shale formation including intermixed nahcolite and dawsonite comprising the following steps:

(1) drilling a series of well into said formation from aboveground, (2) injecting into said formation through said wells an aqueous solution of sodium hydroxide containing a surfactant, so that the sodium hydroxide reacts with the nahcolite to yield sodium carbonate and water, as a sodium carbonate solution, (3) withdrawing the sodium carbonate solution for further processing, and drying the formation, (4) thereafter retorting with controlled pyrolysis the shale in situ, while sending air in controlled amounts down some of said wells, and recovering petroleum products up through other wells, while also decomposing the dawsonite in situ to alumina hydrate and sodium carbonate, (5) thereafter sending water through some of said wells into the retorted formation to produce steam and recovering steam and secondary petroleum through other said wells, (6) adding to said decomposed dawsonite via said wells a dilute water solution of sodium carbonate and extracting the sodium carbonate resulting from the decomposed dawsonite, and withdrawing substantially all the sodium carbonate in solution form, for further processing, while also precipitating calcium carbonate, (7) dissolving the hydrated alumina by reaction with sodium hydroxide added through said wells to yield sodium aluminate and withdrawing it in solution through said wells, (8) heating the calcium carbonate in said formation to convert it to calcium oxide, (9) putting in water through some of said wells and withdrawing steam from other said wells while hydrating the calcium oxide to calcium hydroxide, and

(10) adding sodium carbonate in water solution from step (3) and from step (6), via said wells, to said calcium hydroxide to yield calcium carbonate and sodium hydroxide, and withdrawing said sodium hydroxide, some of said sodium hydroxide being sent to step (2) of a subsequent but basically contemporaneous operation.

14. The process of claim 13 in which there is the additional step of hydrolyzing the sodium aluminate above ground to precipitate hydrated alumina and sodium hydroxide.

15. The process of claim 13 in which there is the additional step of adding $CO_2$ to the sodium aluminate solution to precipitate hydrated alumina and yield sodium carbonate.

16. The process of claim 15 having the additional step of calcining the hydrated alumina.

17. The process of claim 15 in which there is the additional step of adding carbon dioxide to the recovered sodium carbonate aboveground to yield sodium bicarbonate.

18. The process of claim 13 in which there is the additional step (11) of adding carbon dioxide aboveground to the sodium carbonate recovered from steps (3) and (6) to yield sodium bicarbonate.

19. The process of claim 18 including additional step (12) of heating the sodium bicarbonate to form solid sodium carbonate.

20. A process for obtaining useful products from an oil shale formation including intermixed nahcolite and dawsonite comprising the following steps:

(1) drilling a series of wells into said formation from aboveground, (2) injecting into said formation through said wells an aqueous surfactant-containing solution of sodium hydroxide, the sodium hydroxide reacting with the nahcolite to yield sodium carbonate and water, the sodium hydroxide being in an excess of three to ten times stoichiometric for that purpose and thereby also reacting with the dawsonite to form water and sodium aluminate soluble in the alkaline solution, (3) withdrawing the sodium carbonate and sodium aluminate solution for further processing, and drying the formation, (4) thereafter retorting with controlled pyrolysis the shale in situ, while sending air in controlled amounts down some of said wells, and recovering petroleum products up through other wells, (5) burning remaining carbonaceous residue in situ and thereby decomposing calcium carbonate therein to form lime and carbon dioxide, (6) thereafter sending water through some of said wells into the retorted formation to produce steam and recovering the steam through other said wells, meanwhile slaking said lime, (7) providing sodium carbonate in water solution from step (3), via said wells, to the slaked lime to yield calcium carbonate and sodium hydroxide, and withdrawing said sodium hydroxide, some of said sodium hydroxide being used in step (2) of a subsequent operation.

21. The process of claim 20 in which there is the additional step of hydrolyzing the sodium aluminate aboveground to precipitate hydrated alumina and sodium hydroxide.

22. The process of claim 20 in which there is the additional step of adding $CO_2$ to the sodium aluminate solution to precipitate hydrated alumina and yield sodium carbonate.

23. The process of claim 22 having the additional step of calcining the hydrated alumina.

24. The process of claim 22 in which there is the additional step of adding carbon dioxide to the recovered sodium carbonate aboveground to yield sodium bicarbonate.

25. The process of claim 20 in which there is the additional step (8) of adding carbon dioxide aboveground to the sodium carbonate recovered from steps (3) to yield sodium bicarbonate.

26. The process of claim 25 including additional step (9) of heating the sodium bicarbonate to form solid sodium carbonate.

27. The process of any of claims 1, 13, or 20 wherein, in step (2) the injecting step comprises a saturated solution of $NaHCO_3$ containing sufficient NaOH to convert the $NaHCO_3$ to $NaCO_3$ and still leave enough NaOH for the remaining reaction in step (2).

28. The process of any of claims 8, 9, 17, 18, 24 or 25 wherein the addition of the carbon dioxide to the recovered sodium carbonate yields a saturated aqueous solution of sodium bicarbonate as well as the precipitate thereof and then recirculating the saturated sodium bicarbonate solution back to step (2) while reacting it with NaOH.

29. The process of any of claims 1, 13, or 20, wherein, in step (4), the retorting includes igniting the shale and burning it with the combustion front progressing toward the wells through which the air is being injected, countercurrently with the air flow.

30. A process for obtaining useful products from an oil shale kerogen-bearing formation, comprising the following steps:

(1) drilling a series of wells into said formation from above ground, (2) opening passageways between wells in the shale formation, and (3) retorting the shale in situ with controlled pyrolysis to produce thermal decomposition of the kerogen by (a) sending air at ambient atmospheric temperature and in controlled amounts down through some of said wells and injecting it into said passageways, (b) igniting the shale adjacent to other said wells, (c) burning the shale with the combustion front progressing toward the air-injection wells, while maintaining the temperature of pyrolysis between 300° C. and 650° C. so as to produce said thermal decomposition, to vaporize petroleum products and remove them from the shale, and to provide combustible petroleum gases, (d) recovering said vaporized petroleum products through said other wells at about 500° to 1000° F., and (e) condensing said vaporized products to liquid above ground and collecting said gases.

31. A process according to any of claims 1, 13, 20, and 30 wherein the drilling step (1) comprises drilling wells in the pattern of hexagons with a well at each vertex thereof and a well at the center of each hexagon.

32. The process of claim 20 wherein step (5), burning remaining carbonaceous residue, includes producing CO gas.

33. The process of claim 30 wherein after completion of recovery of the petroleum values in the shale, there are the steps of:

injecting water into the air-injection wells, thereby converting the water into steam and cooling the residual shale formation, and withdrawing said steam through said other wells.

* * * * *